United States Patent [19]

Benoit

[11] Patent Number: 4,554,192

[45] Date of Patent: Nov. 19, 1985

[54] THERMOPLASTIC BAG AND THERMOPLASTIC BAG PACK

[75] Inventor: Gordon L. Benoit, Macedon, N.Y.

[73] Assignee: Mobil Oil Corporation, New York, N.Y.

[21] Appl. No.: 606,120

[22] Filed: May 2, 1984

[51] Int. Cl.[4] ..... B65D 1/34; B65D 6/04

[52] U.S. Cl. ..... 428/35; 383/8; 383/121

[58] Field of Search ..... 383/8, 121; 428/35

[56] References Cited .

U.S. PATENT DOCUMENTS

| | | | |
|---|---|---|---|
| 277,153 | 5/1883 | Onderdonk | 383/121 |
| 2,432,122 | 12/1947 | Pardee | 383/121 |
| 2,673,024 | 3/1954 | Kuss | 383/121 |
| 3,119,548 | 6/1964 | Cook et al. | 383/121 |
| 3,254,828 | 6/1966 | Lerner | 383/121 |
| 3,352,411 | 10/1965 | Schwarzkopf | 383/8 |
| 3,549,451 | 3/1966 | Kugler | 383/121 |
| 4,165,832 | 8/1979 | Kuklies et al. | 383/8 |
| 4,476,979 | 10/1984 | Reimann et al. | 383/8 |

FOREIGN PATENT DOCUMENTS

| | | | |
|---|---|---|---|
| 0117730 | 2/1984 | European Pat. Off. . | |
| 1055074 | 4/1952 | France | 383/121 |
| 1010094 | 4/1962 | United Kingdom | 381/121 |

*Primary Examiner*—John E. Kittle
*Assistant Examiner*—James J. Seidleck
*Attorney, Agent, or Firm*—Alexander J. McKillop; Michael G. Gilman; James P. O'Sullivan, Sr.

[57] ABSTRACT

A bag structure of a thermoplastic film material comprising front and rear bag walls connected by side walls and having an open mouth top portion, said open mouth portion being characterized by having handles located at opposite end regions thereof, said handles being of two films as a result of being integral extensions of said front, rear and gusseted side walls; said bag having a bottom wall planarly extensible so as to form a rectangle with at least no substantial excess film outside of the bulk volumetric capacity of said bottom region of said bag.

21 Claims, 8 Drawing Figures

PRIOR ART

THERMOPLASTIC BAG AND THERMOPLASTIC BAG PACK

The present invention relates to a thermoplastic bag having integral handles and also to individual bag packs of such bag structures. The type of bag contemplated herein is particularly adapted for use as a grocery sack capable of carrying loads up to about 30–35 pounds.

For years in the United States the means for carrying items purchased in a grocery store or supermarket has been the paper sack. This sack, as is well known, is made of kraft paper, which has a high beam strength as compared, for example, with thermoplastic film. Thus, bags made of this material, when fully extended, are capable of supporting itself. When such bags are filled with grocery items, they have the desirable attribute of being able to stand upright. In addition, kraft paper bags are made so as to have opposing gusseted sides and a foldable-extensible rectangular bottom. This type of structure, when fully extended, provides the maximum volumetric efficiency for a container of this type. The volume of such a sack is represented by a retangular bottom projected to the height of the bag.

These two attributes are about the only positive aspects of kraft paper grocery sacks. When folded and collapsed they are bulky and occupy considerably more space than thin film thermoplastic grocery sacks. Whatever cost advantage paper grocery sacks enjoyed in the past appears to be disappearing. Paper grocery bags are notorious for their lack of wet strength in an environment which constantly expose them to the deleterious affects of aqueous liquids. This causes the bags to fail and spill their contents on the supermarket floor, the parking lot blacktop, the purchasers automobile, or during transfer from the automobile to the purchasers home. The time needed for supermarket employees to fill kraft paper sacks as, opposed to thermoplastic film grocery sacks, is on average, longer. Such bags produce paper-cuts, which have become an occupational hazard with kraft paper bags. Kraft paper bags have limited reuse possibilities and they are not a stable land fill material.

In the late 1970's and early 1980's, thin film thermoplastic handled grocery sacks began to make significant inroads into an area totally dominated by the kraft paper grocery sack.

U.S. Pat. No. 4,165,832, the disclosure of which is incorporated herein in its entirety, describes to some degree the evolution of handled bags from the time when handle elements were separately attached to the open mouth portion of the bag. This patent also discusses the improvement of forming an ungusseted bag having integral thermoplastic handles as a part thereof. This ungusseted type of bag is constructed from a pillowcase type blank consisting of two sheets of plastic, e.g., from a collapsed tube, sealed at opposite ends. A U-shaped cutout at one end fashions an opening for the bag and a separate cut or slit opens two loops which constitute the handles of the bag. A further evolution in this bag structure came about when the bag was made to have gusseted sides. This permited the handles to be fashioned of two layers of film which gave the handles additional strength. In all cases the bottom of the bag constituted either a heat sealed double layer of film, or in the case of a gusseted structure, the folds of the gusset were sealed at the bottom between the front and back sides of the bag. This latter seal can be considered the "trapped gusset" seal.

Since the late 1970's to the present time, the commercial plastic grocery sack has had a bottom region which has not changed. FIGS. 1–4 of the present application illustrate a thermoplastic film grocery sack of the general type manufactured by almost every thermoplastic grocery sack manufacturer in the United States. This grocery sack is made by collapsing a thermoplastic tube, and while in the process of collapsing, forming therein two side gussets. The gussets are represented in FIG. 2 by in-folded regions 16 and 18 on one side and 20 and 22 on the opposite side. After the gusseted tube has been fully collapsed, it is sealed and severed along lines 26 and 28. Seal line 28 is the handled and open mouth end portion of the bag after plastic film is removed, forming both the bag mouth opening and handles of the bag. Seal line 26 constitutes the closed end of the bag. As will be appreciated, during the sealing of the bottom region of the bag, four films are heat sealed together at the outboard region of the bag, i.e., 12, 16, 18 and 14 on the one side and 12, 20, 22 and 14 on the other side, and in the center region only two films, 12 and 14, are heat sealed together.

This bag bottom structure, adopted almost exclusively by the plastic grocery sack manufacturers, has at least two shortcomings. The first is that whenever there is a thickness transition involving a heat seal, where a thicker region transitions down to a thinner region, as in the gusset region of four layers transitioning at a fold point down to the two layers of the front and rear panels of the sack, a weak spot is created at the fold point. This becomes a tear initiation point as the bag is loaded with goods and the bag tries to expand to accommodate the goods. The bottom of the gusset being trapped and sealed within the front and rear panels of the bag in the regions 32 of FIG. 1 at both bottom outboard regions of the bag, cannot expand to accommodate goods in the bottom of the bag as well as it can in the upper midway region of the bag where the side gussets expand to the maximum. FIG. 3 shows a side view of the bag of FIG. 1 in an expanded condition. It will be noted that the lower region 30 of the bag has less effective volume than the central region 34 of the bag. As indicated, because the bottom of the gusset on both sides of the bag is trapped and sealed between the front and rear layers of the bag walls, they cannot expand to accommodate increasing bag expansion caused by goods being loaded therein. Weight and hoop stress forces are brought to bear at points 36 on both sides of the bag, with the result that tears in the bottom seal are initiated at these points. This asymetrical load distribution places no load on the bottom seal between 36 and the bag corner. As the hoop and load forces increase, the tears can progress to permit product to fall from the bag. Since this type of grocery sack is suspended from its integral handles, there is no bottom support safeguard to protect items from falling through the bottom of such a bag.

The second disadvantageous aspect of such a seal-trapped gusset arrangement is the fact that the sides of the bag cannot expand to their full width and, thus, full volumetric efficiency is sacrificed. When examined carefully, for example in a bag as described measuring 12 inches by 8 inches (4 inch gussets) by 24 inches, including handle length, a significant percentage of the bag film (excluding the handles) does not contribute to bag volume. Over 8% of the bag film is wasted in the bottom of the bag because of the trapped gussets.

U.S. Pat. No. 3,119,548, issued Jan. 28, 1964, describes a thermoplastic bag having a square or rectangular bottom which avoids the trapped gusset structure. This sack, however, is intended as a liner for a cardboard ice-cream container. Thus, this structure never was intended to support product load by means of its own integrity. An outer-container provided shape and support for the thermoplastic liner. This liner is not used with handles.

U.S. Pat. No. 3,580,486 describes a thermoplastic film bag which has a rectangular bottom without a seam or seal, and ungusseted sides which contain three seals when the bag is expanded. This bag contains a center handle which is only one film layer thick because of the ungusseted side structure.

It is an object of the present invention to present a novel thermoplastic film bag and bag pack.

Yet another object of the invention is to present a thermoplastic film handled grocery sack which has maximum volumetric efficiency.

Still another object of the present invention is to present a thermoplastic film grocery sack having seam seals of exceptional integrity.

A further object of the present invention is to present a thermoplastic film handled sack which has a minimum of film not contributing to either volumetric capacity or handle support.

A still further object of the present invention is to present a thermoplastic film grocery sack which contains considerably less raw material for essentially the same volumetric capacity as trapped-gusset bags.

SUMMARY OF THE INVENTION

The present invention is concerned with a bag structure of a thermoplastic film material comprising front and rear bag walls connected by gusseted side walls and having an open mouth top portion, said open mouth portion being characterized by having handles located at opposite end regions thereof, said handles each being of two films as a result of being integral extensions of said front, rear and gusseted side walls; said bag having a bottom wall planarly extensible so as to form a rectangle with at least no substantial excess film outside of the bulk volumetric capacity of the bottom region of said bag.

The present invention is also concerned with a bag structure of a thermoplastic film material comprising front and rear bag walls connected by gusseted side walls and having an open mouth top portion, said open mouth portion being characterized by having handles located at opposite end regions thereof, said handles each being of two films as a result of being integral extensions of said front, rear and gusseted side walls; said bag having a bottom wall planarly extensible so as to form a rectangle, said bottom being of integral extensions of said front, rear and gusseted side walls and the closure thereof being 4 two-film, gusset-to-wall, heat seals when said bottom is a square and 4 two-film, gusset-to-wall, heat seals and 1 two-film, front wall-to-back wall heat seals when said bottom is a rectangle.

DETAILED DESCRIPTION OF THE INVENTION

Figure 3:
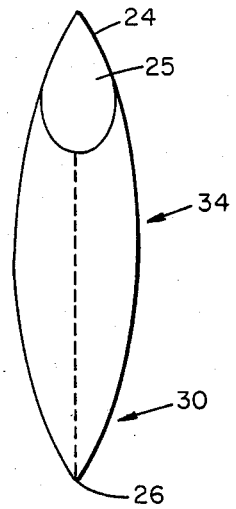
FIG. 3 is a side elevation view of the bag structure of FIG. 1 in volume expanded form.

As indicated above, FIGS. 1, 2, 3 and 4 represent different views of a bag structure 10 of the prior art. This bag has a front panel 12, a back panel 14 and gusseted sides represented by infolded members 16, 18, 20 and 22. The gussetted members are actually single side members creased at their longitudinal midpoint. Double film handles 24 are at the bag mouth end of the bag and these handles are sealed at line 28. Handle loop opening 25 is shown in FIG. 3. The bottom of bag 10 is sealed along line 26. As indicated above this seal line 26 traps the side gussets at the bottom of the bag and prevents the bag from expanding fully, as more clearly shown in the region 30 of FIG. 3. This manner of sealing the bottom of the bag inadvertently produces tear initiation points 36 when bag filling forces attempt to expand the side gussets in the bottom region of the bag.

Figure 1:
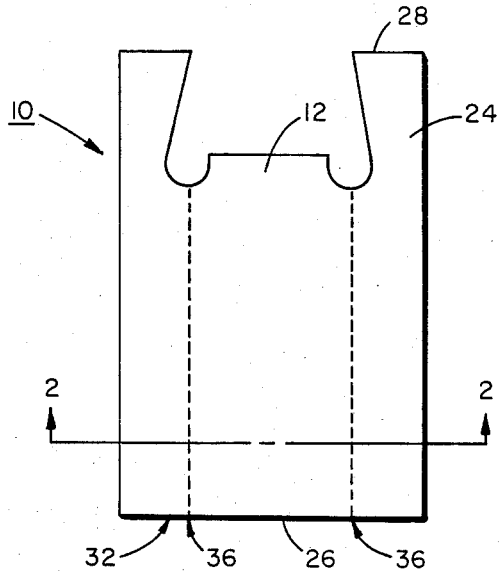
FIG. 1 is a front elevation view representing a thermoplastic sack of the prior art.
Figure 2:
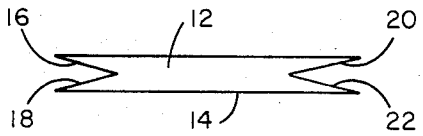
FIG. 2 is an end view taken along the lines 2—2 of FIG. 1.
Figure 4:
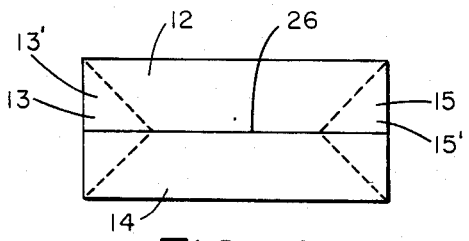
FIG. 4 is a bottom view of the bag of FIG. 1 with the bottom of the bag planarly extended to the exact dimensions of the four sides of the bag.
Figure 5:
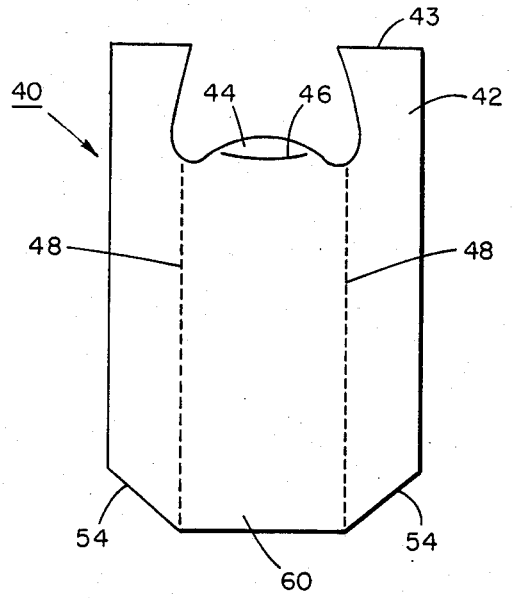
FIG. 5 is a front elevation view of one form of the thermoplastic bag structure of the present invention.

FIG. 4 is illustrated herein in order to show that when a bag of the prior art, such as that illustrated in FIGS. 1, 2 and 3, has the bottom thereof planarly extended to the full dimensions of its sides and walls there will seem to be two perfectly square segments of thermoplastic film externally of the inside of the bag which contributes nothing to the volumetric capacity of the bag. Moreover, this excess apparently does not contribute to the strength of the bag. This figure is best appreciated by envisioning a cardboard box having the exact front width, gusset-side and rear width dimensions of the prior art bag illustrated in FIG. 1. When such a box is placed into the bag, so that like sides of the bag and the box correspond, and the box is pushed snugly to the bottom of the bag then the bottom of the bag will assume the configuration shown in FIG. 4. Part of front panel 12 of the bag will actually become part of the bottom of the bag, as will back panel 14. Bottom heat seal seam 26 will extend all the way across the mid-point region of the bottom of the bag. By placing such a box within the bag, there will be formed, in the exterior of the bottom of the bag, two triangular shaped pockets, made up of identical right-angle triangular film members, 13 and 13' on one side and 15 and 15' on the other side. The present invention has discovered that the two triangular pockets can be removed by the elimination of triangles 13 and 13' and 15 and 15', which together constitute two perfectly square segments of film which do not materially contribute to the structural integrity or the volumetric efficiency of the bag. After removal of these segments and forming the appropriate bottom seals from adjacent film edge regions, the bag then has the bottom configuration shown in FIG. 7. The result is a savings of a considerable percentage of the raw material employed in the bag and the creation of the first practical flat-bottomed thermoplastic sack having double film handles as more fully described with reference to the remaining Figures.

Figure 8:
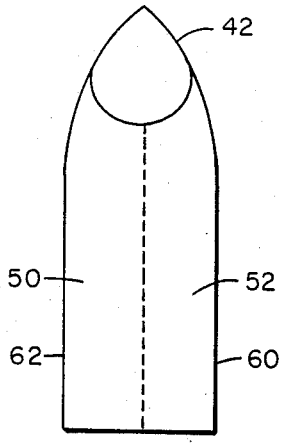
FIG. 8 is a side elevation view of the bag structure of FIG. 5 in volume expanded form.
Figure 6:
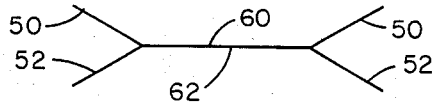
FIG. 6 is a bottom end view of the bag structure of FIG. 5.

FIGS. 5, 6, 7 and 8 illustrate a rectangular bottom bag 40 having double film thickness handles 42 at the bag mouth end of the bag. These handles are sealed along lines 43. Each bag has two tabs 44 in registration and each has a preweakened tear-off region 46 for removal of each bag 40 from a plurality of superimposed bags connected together by way of tabs 44 in some suitable fashion. They may be, heat-bonded, stappled, clipped or held together by any means. Preweakend region 46 can be a line of perforations for bag tear-off or a continuous, somewhat arcuate slit terminating just short of the mouth of the bag, leaving two small web regions which can be snap-severed to free a bag from a bag pack. Dotted lines 48 illustrate the extent of infolding of gusset members 50 and 52, as more clearly shown in FIG. 6. When fully extended, these gusset members become bag sides 50–52 as shown in FIG. 8.

Figure 7:
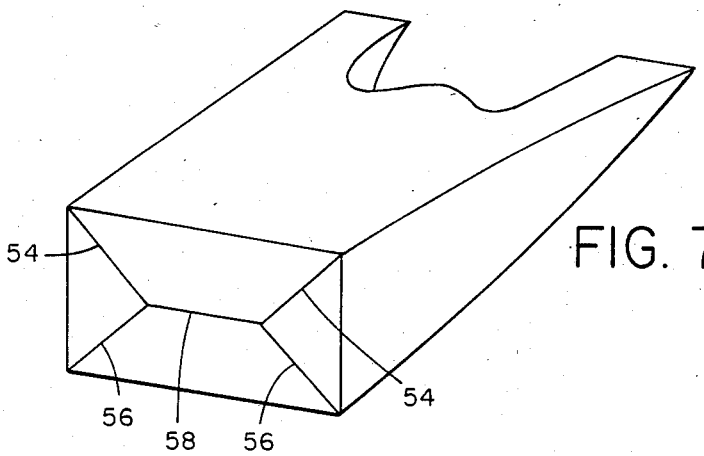
FIG. 7 is a bottom perspective view of the bag structure of FIG. 5 in volume expanded form.

The bottom of bag 40 is constructed of 5 two-film heat seals. There are two heat seals 54, two heat seals 56 and a central heat seal 58. Heat seal 58 is the result of heat sealing front bag panel 60 to rear bag panel 62. Heat seal 54 is formed by heat sealing front bag panel 60 to gusset panel 50 and heat seal 56 is formed by heat sealing rear bag panel 62 to gusset panel member 52. As will be appreciated, the bottom is formed by heat sealing no more than two films at any one point. This avoids any tear initiation point resulting from sealing a thick region to a thin region. The unnumbered outer peripheral lines of the bottom of FIG. 7 are shown as if a perfect rectangular object were giving it this form. This would be the ideal utilization of such a bag and is so shown to illustrate the greater available volume of the subject bag.

A double film handle rectangular bottom bag is a novel structure particularly for supporting loads up to and greater than about 35 pounds. The above described structure results in a thermoplastic bag which can be laid flat, as with the prior art structure, and occupy no more vertical space than the prior art bags. As indicated above, they can be fashioned into bag packs of any suitable number and hung from the region of tab 44 in some suitable manner for dispensing the bags one at a time. In use, product will be placed through the bag mouth opening and as more product is loaded into the bag the bottom thereof will attempt to become planarly extended. In so doing, the maximum volumetric efficiency can be utilzed. By "planarly extended" or "planarly extensible" is meant that the bottom of the bag can, unrestrictedly be extended to be perfectly flat and rectangular in shape. For having the capability of forming a perfectly flat bottom, seal line 54 and 56 should form at least approximately a 45° angle with gusset line 48 or an angle of at least approximately 135° with seal line 58 when the bag is in its lay flat condition. Obviously, these angles can deviate more or less from these limits but the consequence will be a bag bottom which is correspondingly less planar. This is still within the spirit of the invention. Thus, it is the intention of the present invention to cover bag bottoms of the described type which are at least generally planar when the bag is extended.

Bags of the structure described can be formed by employing any suitable thermoplastic material, such as a polyolefin, and more particularly polyethylene of any gauge, for example a gauge that ranges from about 0.25–5 mils. In employing the term "polyethylene," it is employed generically to include all forms of polyethylene including, low density polyethylene, linear low density copolymers of ethylene and another alpha olefin, high density polyethylene, mixtures and blends of the same, etc. thermoplastic coated paper stock is also contemplated.

A method of preparing an at least substantially flat, rectangular bottom, handled thermoplastic sack of the present invention comprises:

(a) forming a tube of a thermoplastic film;

(b) collapsing said tube while simultaneously forming therein two oppositely disposed, parallel gussets;

(c) forming two pairs of diagonal sealed seams over the portions of the tube width corresponding to the gussets along lines diagonal to the length of the tube, the seal-pairs of opposite sides being at an angle to one another and the seam of each pair being in registration with one another;

(d) forming a transverse sealing and severing seam across and through said collapsed tube along a line which includes the inboard ends of said pairs of diagonal seams;

(e) collecting the resulting structures in a stack;

(f) removing the four folded triangles of film between the diagonal sealed seams and the transverse sealing and severing seam to complete the bottom of the sack; and (g) forming a handle and sack mouth opening at the opposite end of said sack bottom.

The bags can also be constructed so as to be interconnected head to tail or tail to tail, etc. by means of preweakend film segments. This will permit the formation of a plurality of bags in a roll or a zig-zag stack for easy dispensing of individual bags.

In a modification of the bag structure illustrated in FIGS. 5, 6, 7 and 8, the gusset lines 48 can be in-folded to a maxiumum so that they meet at the midline of the bag. The consequence of this modification, after cutting the corners at an angle of at least approximately 45° to the midline and then forming the two-film seals, as indicated above, will be a square bottomed bag. In the instance of a square bottomed bag, the two-film heat seal, line 58 of FIG. 7, for example, is reduced to nonexistence. The two apexes of the heat seals 54 and 56 contact one another and the bottom of the bag then will have an X shape heat seal with the lines forming the X being at least approximately equal. Another way of stating it is, that the bottom closure of the bag is formed from 4 two-film heat seals. A suitable bag mouth opening and double film handle are also fashioned into the bag.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A bag structure of a thermoplastic film material comprising front and rear bag walls connected by gusseted side walls and having an open mouth top portion, said open mouth portion being characterized by having handles located at opposite end regions thereof, said handles each being of two films as a result of being integral extensions of said front, rear and gusseted side walls; said bag having a bottom wall planarly extensible so as to form an at least generally flat rectangle, said bottom being of integral extensions of said front, rear and side walls, said bottom having all two-film seals, with no substantial excess film outside of the bulk volumetric capacity of the bottom region of said bag.

2. The bag structure of claim 1 having no substantial trapped gusset in said bag bottom.

3. The bag structure of claim 1 wherein said handles are loop handles sealed together at the top thereof.

4. The bag of claim 1 wherein said bag mouth is further characterized by having arcuate stress relief areas positioned at opposite ends of said mouth and adjacent the lower portions of said handle and the upper edges of said mouth extending above said arcuate areas.

5. The bag of claim 1 wherein said bag bottom is planarly extensible to at least approximately a flat square.

6. The bag of claim 1 wherein said bag bottom is planarly extensible to at least approximately a flat rectangle having unequal length and width dimensions.

7. The bag structure of claim 1 having two detachable tabs each as an integral extension of a separate edge of said mouth.

8. A bag pack comprising a plurality of stacked thermoplastic bag structures of claim 6, said bag structures being bonded together at said detachable tabs.

9. A roll of bags of the structure of claim 1 wherein a plurality of such bags are interconnected by way of at least one preweakened film link or interconnection between each bag structure and so adapted to permit individual bag severance from said roll.

10. A stack of bags in zig-zag arrangement, said bags being of the structure of claim 1, and wherein a plurality of such bags are interconnected by way of at least one preweakened film link or interconnection between each bag structure and so adapted to permit individual bag severance from said stack.

11. A grocery bag structure of a thermoplastic film material comprising front and rear bag walls connected by gusseted side walls and having an open mouth top portion, said open mouth portion being characterized by having handles located at opposite regions thereof, said handles being of double films as a result of being integral extensions of said front, rear and gusseted side walls; said bag having a bottom wall planarly extensible so as to form an at least generally flat rectangle, said bottom being of integral extensions of said front, rear and side walls and the closure thereof being 4 two-film gusset-to-wall heat seals, when said bottom is at least approximately a square, and 4 two-film gusset-to-wall heat seals and 1 two-film front wall-to-back wall heat seal when said bottom is at least approximately a rectangle having unequal length and width dimensions.

12. The bag structure of claim 11 wherein said handles are loop handles sealed together at the top thereof.

13. The bag of claim 11 wherein said bag mouth is further characterized by having arcuate stress relief areas positioned at opposite ends of said mouth and adjacent the lower portions of said handle and the upper edges of said mouth extending above said arcuate areas.

14. The bag of claim 11 wherein said bag bottom is planarly extensible to at least approximately a flat square.

15. The bag of claim 11 wherein said bag bottom is planarly extensible to at least approximately a flat rectangle having unequal length and width dimensions.

16. The bag structure of claim 11 having two detachable tabs each as an integral extension of a separate edge of said mouth.

17. A grocery bag pack comprising a plurality of stacked thermoplastic bag structures of claim 16, said bag structures being bonded together at said detachable tabs.

18. A roll of grocery bags of the structure of claim 11 wherein a plurality of such bags are interconnected by way of at least one preweakened film link or interconnection between each bag structure and so adapted to permit individual bag severance from said roll.

19. A stack of grocery bags in zig-zag arrangement, said bags being of the structure of claim 11, and wherein a plurality of such bags are interconnected by way of at least one preweakened film link or interconnection between each bag structure and so adapted to permit individual bag severance from said stack.

20. The bag structure of claim 11 having no substantial excess film outside of the bulk volumetric capacity of the bottom region of said bag.

21. In a grocery bag structure of a thermoplastic film material comprising front and rear bag walls connected by gusseted side walls and having an open mouth top portion, said open mouth portion being characterized by having handles located at opposite end regions thereof, said handles each being of two films as a result of being integral extensions of said walls; the improvement comprising a bottom wall planarly extensible so as to form an at least generally flat rectangle, said bottom being of integral extensions of said front, rear and side walls and the closure thereof being 4 two-film, gusset-to-wall, heat seals, when said bottom is at least approximately a square, and 4 two-film gusset-to-wall heat seals and 1 two-film front wall-to-back wall heat seal when said bottom is at least approximately a rectangle having unequal length and width dimensions; said bottom wall permitting full expansion of the bottom region of the gusseted side walls.

* * * * *